US010349745B2

(12) United States Patent
Huang et al.

(10) Patent No.: US 10,349,745 B2
(45) Date of Patent: Jul. 16, 2019

(54) ELECTRIC MECHANICAL STRETCHING DEVICE OF MOVABLE SOFA

(71) Applicant: REMACRO MACHINERY & TECHNOLOGY (Wujiang) Co, Ltd., Suzhou (CN)

(72) Inventors: Xiaowei Huang, Suzhou (CN); Xiaohong Li, Suzhou (CN); Haibo Wang, Suzhou (CN); Guoli Zou, Suzhou (CN); Linlin Wu, Suzhou (CN)

(73) Assignee: REMACRO MACHINERY & TECHNOLOGY(WUJIANG) CO, LTD, Suzhou (CN)

( * ) Notice: Subject to any disclaimer, the term of this patent is extended or adjusted under 35 U.S.C. 154(b) by 146 days.

(21) Appl. No.: 15/509,488

(22) PCT Filed: Aug. 20, 2015

(86) PCT No.: PCT/CN2015/087665

§ 371 (c)(1),
(2) Date: Mar. 8, 2017

(87) PCT Pub. No.: WO2016/037522

PCT Pub. Date: Mar. 17, 2016

(65) Prior Publication Data

US 2017/0258230 A1 Sep. 14, 2017

(30) Foreign Application Priority Data

Sep. 9, 2014 (CN) ..... 2014 2 0514326 U

(51) Int. Cl.
*A47C 1/031* (2006.01)
*A47C 1/035* (2006.01)
(Continued)

(52) U.S. Cl.
CPC ..... *A47C 1/035* (2013.01); *A47C 1/0355* (2013.01); *A47C 17/1756* (2013.01)

(58) Field of Classification Search
CPC ..... A47C 1/035; A47C 1/034; A47C 1/0345; A47C 1/0355; A47C 17/1756;
(Continued)

(56) References Cited

U.S. PATENT DOCUMENTS 6,604,791 B1 * 8/2003 Chen ..... A47C 1/035 297/300.1
8,419,122 B2 * 4/2013 Lawson ..... A47C 1/035 297/259.2
(Continued)

FOREIGN PATENT DOCUMENTS

CN 102133005 A 7/2011
CN 102133006 A 7/2011
(Continued)

*Primary Examiner* — Chi Q Nguyen

(57) ABSTRACT

An electrical mechanical stretching device of a movable sofa includes a mechanical stretching device and an electrical device, wherein the mechanical stretching device includes a third leg rod and a third connecting rod. The electrical device consists of a motor sliding block connecting pipe, a motor, a motor leg fixing pipe, a motor guide rail and a motor sliding block. The motor is provided with the motor guide rail. The motor sliding block is mounted on the motor guide rail. A motor end is rotatably connected via a second rotating shaft to the motor leg fixing pipe which is fixed on the third leg rod. The motor sliding block is rotatably connected via a first rotating shaft to the motor sliding block connecting pipe which is fixed on the third connecting rod. A base of the mechanical stretching device is connected by two bottom connecting pipes.

10 Claims, 5 Drawing Sheets

(51) Int. Cl.
*A47C 17/175* (2006.01)
*A47C 1/0355* (2013.01)

(58) Field of Classification Search
CPC ..... A61G 15/02; A61G 15/12; B64D 11/064; B64D 11/0643; B60N 2/62; B60N 2/02
USPC ... 297/85 M, 69, 317, 316, 311, 330, 83, 68
See application file for complete search history.

(56) References Cited

U.S. PATENT DOCUMENTS

2011/0175404 A1* 7/2011 Lawson ..... A47C 1/0355 297/83
2011/0175426 A1* 7/2011 Lawson ..... A47C 1/0355 297/85 M
2011/0181094 A1* 7/2011 Lawson ..... A47C 1/035 297/85 R
2011/0248547 A1 10/2011 LaPointe et al.
2012/0049606 A1* 3/2012 Lawson ..... A47C 1/0355 297/85 M
2012/0112519 A1* 5/2012 Murphy ..... A47C 1/0355 297/85 M
2013/0175847 A1* 7/2013 Lawson ..... A61G 5/14 297/85 M
2013/0285433 A1* 10/2013 Yamada ..... B60N 2/995 297/423.3
2014/0021760 A1* 1/2014 Masters ..... A61G 5/14 297/313
2014/0049084 A1* 2/2014 Lawson ..... A47C 1/032 297/340
2014/0333108 A1* 11/2014 Fischer ..... A47C 1/0352 297/311
2014/0368011 A1* 12/2014 Lapointe ..... A61G 5/14 297/316

FOREIGN PATENT DOCUMENTS

CN I02160717 A 8/2011
CN 103637579 A 3/2014
CN 103932521 A 7/2014
CN 203852053 U 10/2014
CN 204158028 U 2/2015

* cited by examiner

ELECTRIC MECHANICAL STRETCHING DEVICE OF MOVABLE SOFA

CROSS REFERENCE TO RELATED APPLICATIONS

This application is the national phase of International Application No. PCT/CN2015/087665, filed on Aug. 20, 2015, which is based upon and claims priority to Chinese Patent Application No. 2014205143261, filed on Sep. 9, 2014, the entire contents of which are incorporated herein by reference.

TECHNICAL FIELD

The present invention relates to an electrical mechanical stretching device of a movable sofa, in particular, to a multifunctional electrical mechanical stretching device of a movable sofa in which the leg thereof can be folded or unfolded, and the angle of the backrest thereof is adjustable.

BACKGROUND

Currently, the electrical mechanical stretching device of the movable sofa in the prior art has four significant defects. 1, In the market, the structure of the electrical driving means of the movable sofa is too complex, affecting the kinetic efficiency of the motor. 2, In the market, the electrically driving means of the movable sofa causes shaking, affecting the comfortability of the movable sofa. 3, In the market, the electrical driving means of the movable sofa are difficult to install, affecting the installation efficiency of the movable sofa. 4, In the market, since the motor head of the electrical driving means of the movable sofa project outside the electrical connecting rod, interference will occur when the leg is completely folded, affecting the function of the sofa and the stability of the structure. Referring to FIG. 5, in the market, the electrical device of the electrical driving means of the movable sofa in the prior art includes electrical rectangular pipe 10, electrical angle iron 11, transmission part 12, transmission fixing support 13, comparing motor head fixing part 14 (hereinafter, the word "comparing" in the context is used to distinguish different embodiments), comparing motor connecting rod 15, motor fixing part 16, motor tail fixing part 17, comparing motor movable sliding block 18, comparing motor 19, rotating shaft transmission part 20, rotatable connecting rod 21, and comparing electrical connecting rod 9. It is necessary to fix the front end and the rear end of comparing motor 19 on comparing motor connecting rod 15 and the comparing electrical connecting rod 9, respectively. By assembling transmission part 12, the transmission fixing support 13, and the motor fixing part 16 as an electrical rotatable connecting pall, the linear movement of comparing motor movable sliding block 18 on comparing motor 19 is transformed into the rotating movement of electrical rectangular pipe 10 and the electrical angle iron 11, such that rotating shaft transmission part 20 and rotatable connecting rod 21 that are connected to electrical rectangular pipe 10 are driven to rotate, and thus the mechanical stretching device is driven to move. Since self-locking of the iron frame may happen during the rotation of rotating shaft transmission part 20 and rotatable connecting rod 21, the problem that the electrical driving mechanism will cause shaking is raised. The present invention makes improvements based on the above prior art.

SUMMARY

Technical Problem

The technical problem of the present invention is to overcome the above defects in the prior art, and provide a movable sofa mechanical stretching device which has a simple structure, an easy usage, a low cost, and a good effect.

TECHNICAL SOLUTION OF THE PROBLEM

Technical Solution

The technical solution of the present invention solving the above technical problem is an electrical mechanical stretching device of a movable sofa, which includes a mechanical stretching device and an electrical device. The mechanical stretching device includes a third leg rod and a third connecting rod. The electrical device includes a motor sliding block connecting pipe, a motor, a motor leg fixing pipe, a motor guide rail, and a motor sliding block. The motor has a motor guide rail. The motor sliding block is mounted on the motor guide rail. The motor head is rotatably connected via a second rotating shaft to the motor leg fixing pipe, which is fixed on the third leg rod. The motor sliding block is rotatably connected via a first rotating shaft to the motor sliding block connecting pipe, which is fixed on the third connecting rod. Thus, an electrical bottom connecting rod is not necessary. The driving manner and structure of the motor are simple. The pushing force of the motor directly acts on the leg structure of the mechanical stretching device. The structure is strong and firm and is helpful for improving the kinetic efficiency of the motor.

The electrical mechanical stretching device of the present invention has a simple structure. The base of the mechanical stretching device is connected via two bottom connecting pipes, such that the efficiency of installation and maintenance of the mechanical stretching device is improved.

The present invention solves the shaking problem of the electrical driving means of the movable sofa in the market, and improves the comfortability of the movable sofa.

The motor of the present invention is easy to install. Both the first rotating shaft and the second rotating shaft use a pin, such that the motor movable sliding block on the motor is connected to the motor head via the pin. Thus, the installation efficiency of the motor is improved notably.

The present invention solves the problem that the motor head always projects outside the electrical connecting rod in the current electrical driving means. As a result, when the leg is completely folded, the interference can be avoided. Thus, the stability of the structure of the movable sofa is improved.

THE BENEFICIAL EFFECT OF THE INVENTION

Beneficial Effect

The electrical driving function of the movable sofa of the present invention has advantages of simple and strong structure, high reliability, high driving efficiency, and easy installation and maintenance.

BRIEF DESCRIPTION OF THE DRAWINGS

Description of Drawings

Figure 1:
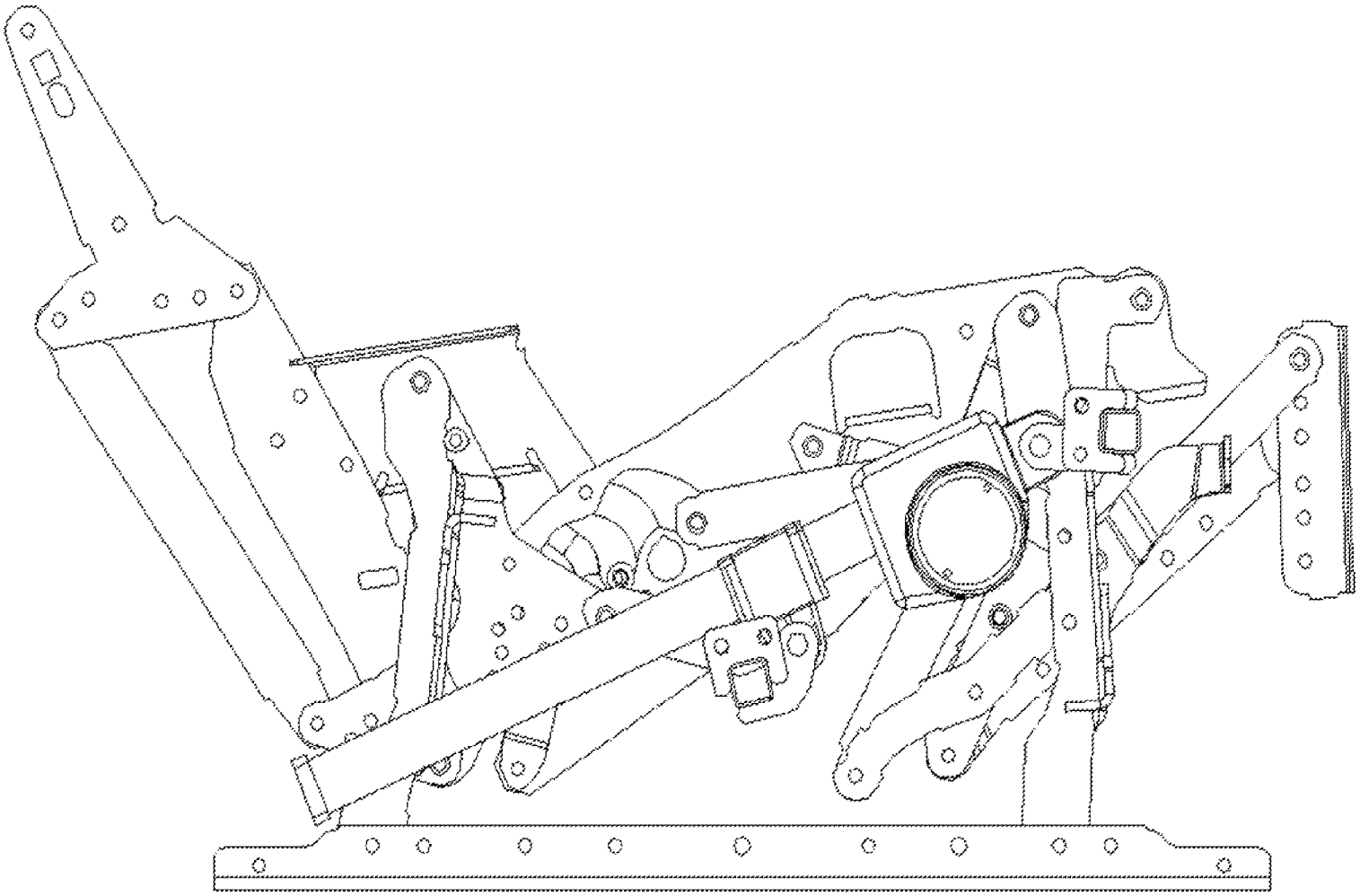

FIG. 1 is a front schematic diagram of the embodiment of the present invention when the left part or the right part of the kg is completely folded.

Figure 2:
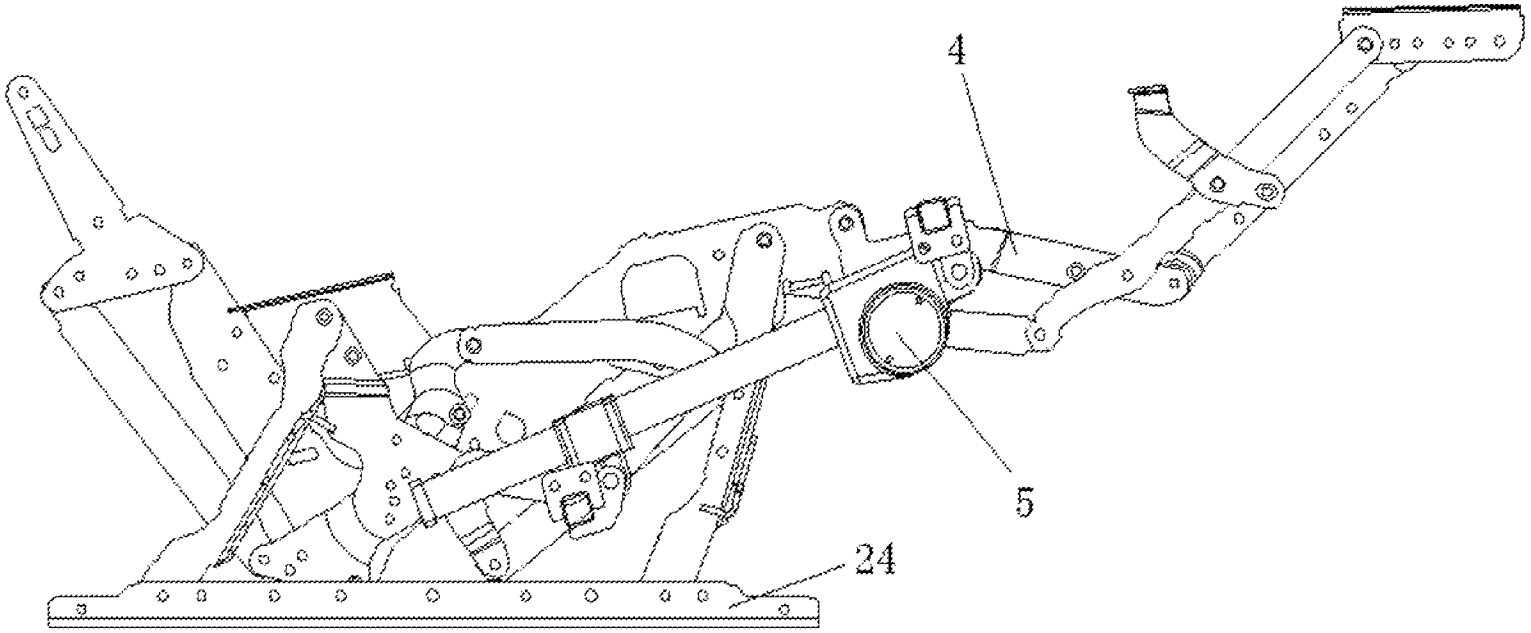

FIG. 2 is a front schematic diagram of the embodiment of the present invention when the left part. or the right part of the leg is completely unfolded.

Figure 3:
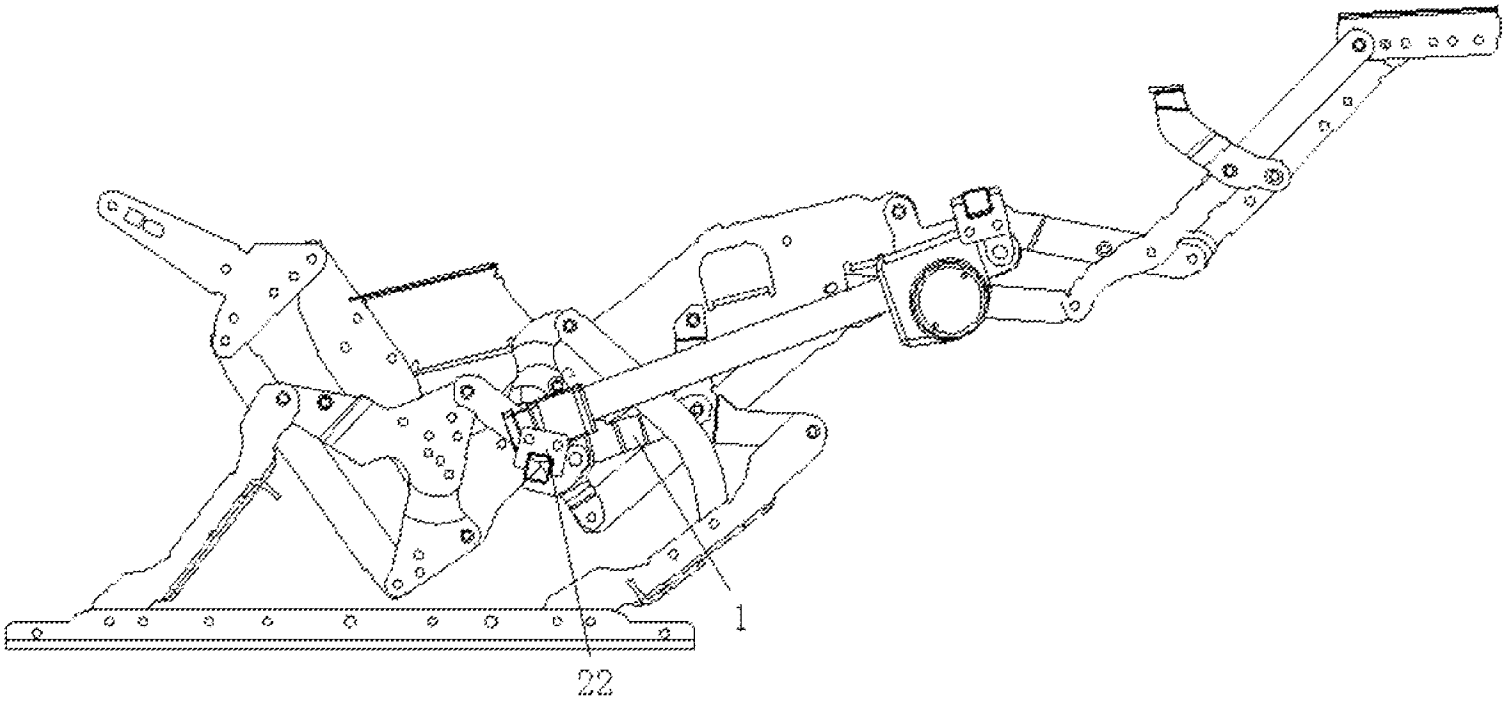

FIG. 3 is a schematic diagram of the present invention when the backrest is completely put down.

Figure 4:
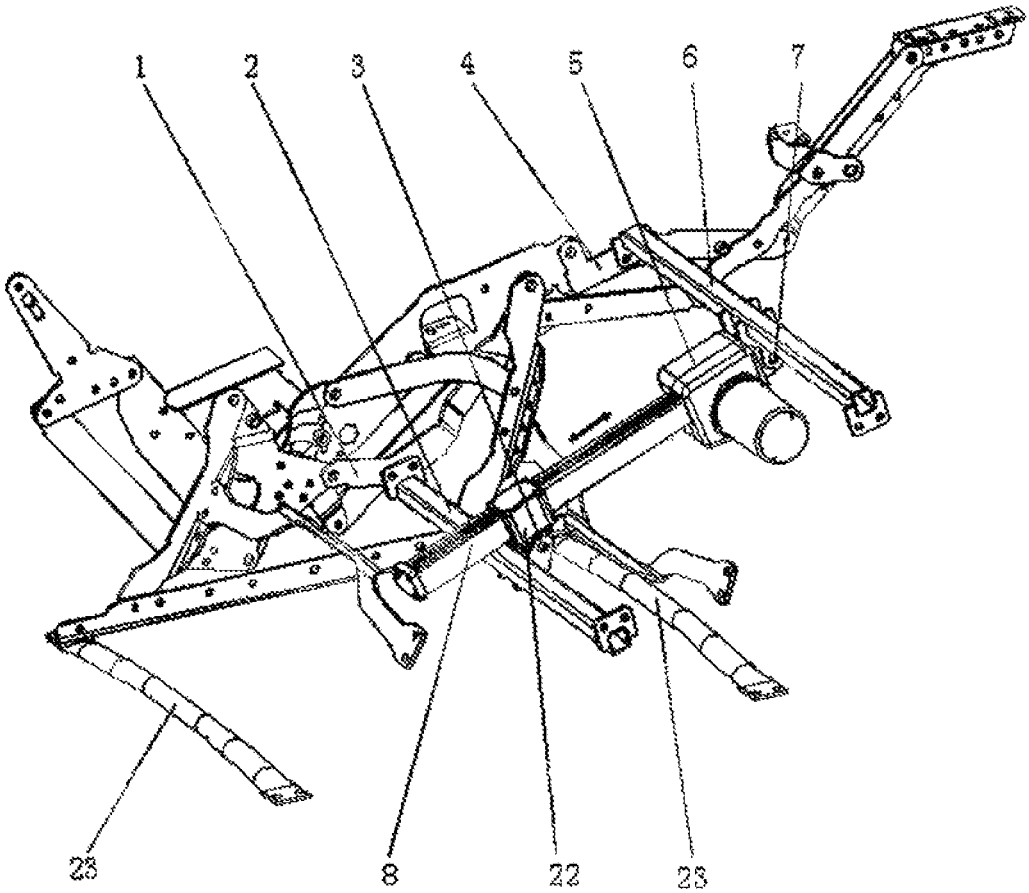

FIG. 4 is a schematic diagram of the composition and operation manner of the main parts of the embodiment of the present invention. In the FIG. 1—third connecting rod; 2—motor sliding block connecting pipe; 3—first rotating shaft; 4—third leg rod; 5—motor; 6—motor leg fixing pipe; 7—second rotating shaft; 8—motor guide rail; 22—motor sliding block; 23—bottom connecting pipe; 24—base.

Figure 5:
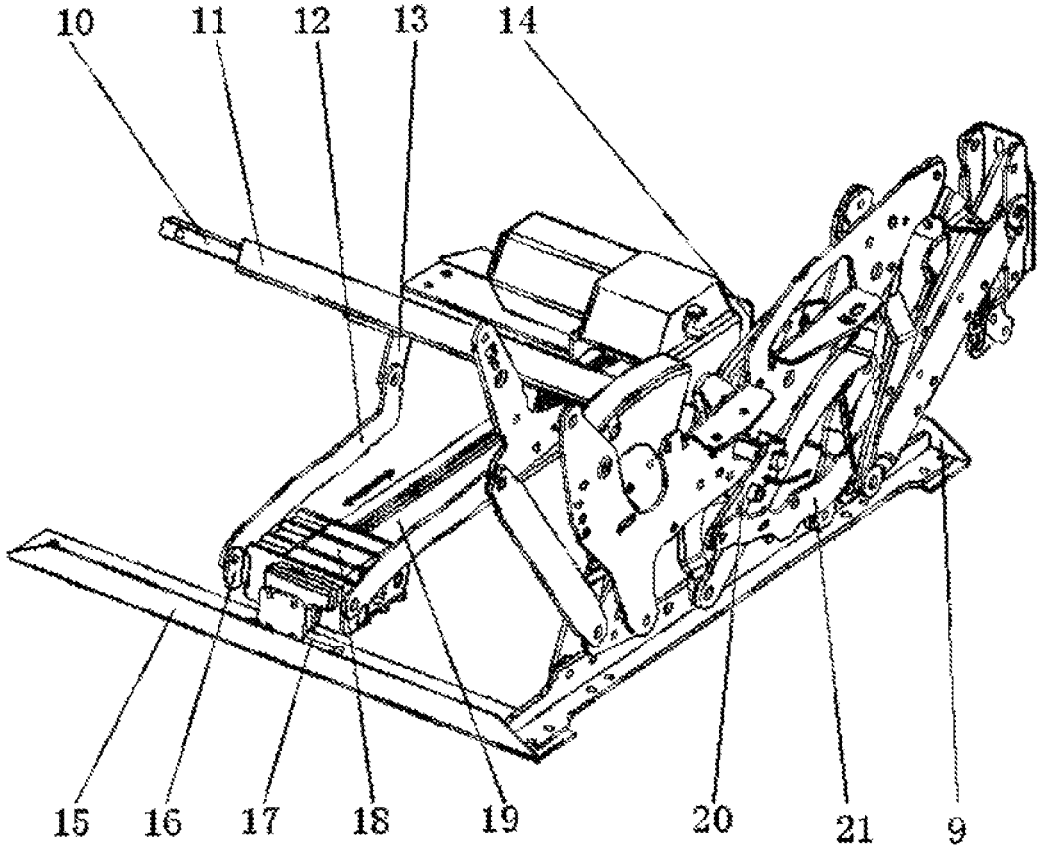

FIG. 5 is a schematic diagram of the composition and operation manner of the main parts of the prior art. In the Figure: 9—comparing electrical connecting rod; 10—electrical rectangular pipe; 11—electrical angle iron; 12—transmission part; 13—transmission fixing support; 14—comparing motor head fixing part; 15—comparing electrical connecting rod; 16 motor fixing part; 17—motor tail fixing part; 18—comparing motor movable sliding block; 19—comparing motor; 20—rotating shaft transmission part; 21—rotatable connecting rod.

DETAILED DESCRIPTION

Hereinafter, the present invention is further described with reference to the drawings and the embodiments.

The electrical mechanical stretching device of movable sofa of an embodiment includes a mechanical stretching device in the prior art (which has a left part and a second part that are the same, wherein the left. part is fixedly connected to the right part via a fixing part). The mechanical stretching device has third connecting rod 1, third leg rod 4, and base 24. Structural features of this device are that electrical device includes motor sliding block connecting pipe 2, motor 5, motor leg fixing pipe 6, motor guide rail 8, and motor sliding block 22. Motor 5 uses a guide rail motor. The head of motor 5 is rotatably connected via second rotating shaft 7 to motor leg fixing pipe 6. Motor leg fixing pipe 6 is fixed on third leg rod 4 of the mechanical stretching device. Motor sliding block 22 is rotatably connected via first rotating shaft 3 to motor sliding block connecting pipe 2. Motor sliding block connecting pipe 2 is fixed on third connecting rod 1 of the mechanical stretching device. Motor sliding block 22 moves on motor guide rail 8 of motor 5.

Motor leg fixing pipe 6 of the embodiment is fixed on third leg rod 4 of the mechanical stretching device, such that the pushing force of motor 5 directly acts on the leg structure of the mechanical stretching device. Motor sliding block 22 moves along motor guide rail 8, such that the direction of the driving force of motor 5 is consistent with the direction of unfolding of the embodiment as much as possible. Thus, the energy is saved, the mechanical loss is reduced, and the entire structure is enhanced.

Industrial Utility

The moving principle of the embodiment is that motor sliding block 22 on motor 5 moves on motor guide rail 8, so as to drive motor leg fixing pipe 6 which is fixed on third leg rod 4 via second rotating shaft 7. Motor leg fixing pipe 6 is fixed on third leg rod 4 of the mechanical stretching device. Bearing the weight of a person, motor sliding block 22 moves towards the motor head, causing the leg structure of the electrical mechanical stretching device of movable sofa to unfold first. After the leg structure is completely unfolded such that the limited position contacts the contacting surface, the leg structure is prevented from unfolding mechanically. Thus, the backrest structure of the electrical mechanical stretching device of movable sofa is put down completely. As such, the electrical mechanical stretching device of movable sofa achieves the transition from the status shown in FIG. 1 to FIG. 2 and further to FIG. 3. Vice versa, when motor movable sliding block 22 moves along a direction leaving the motor head, the electrical mechanical stretching device of movable sofa can achieve the transition from the status shown in FIG. 3 to FIG. 2 and further to FIG. 1. When the electrical mechanical stretching device of movable sofa is in the status shown in FIG. 1, i.e., when the leg is completely folded, the electrical driving function of the movable sofa mechanical stretching device is realized.

Since in the embodiment, the first rotating shaft 1 and the second rotating shaft 7 are rotatably connected to each other via the pin connection, the pin connection of the motor is realized.

The embodiment eliminates the rotating connection between rotating shaft transmission part 20 and rotatable connecting rod 21, and solves the shaking problem of the electrical driving manner.

In the embodiment, base 24 is fixedly connected via two bottom connecting pipes 23. The structure is simple. The cost is low. Connections between comparing motor connecting rod 15, comparing electrical connecting rod 9, and base 24 are eliminated.

The embodiment added a new electrically driving method for the movable sofa, which avoids the electrically driving method in the prior art. The electrical installation and operation efficiency of the movable sofa is improved. The automaticity and comfortableness of the sofa are enhanced.

Simple variations and equivalent alternations of the present invention are construed as falling within the scope of the present invention.

What is claimed is:

1. An electrical mechanical stretching device of movable sofa, comprising:

a mechanical stretching device;

a driving device;

wherein the driving device includes a leg fixing tube, a sliding block connecting tube, a sliding block, and a driving part;

both ends of the leg fixing tube and the sliding block connecting tube are fixedly mounted on the mechanical stretching device respectively;

the sliding block is mounted on the driving part;

the driving part is rotatably connected to the leg fixing tube; and the sliding block is rotatably connected to the sliding block connecting tube.

2. The electrical mechanical stretching device of movable sofa of claim 1, wherein the mechanical stretching device includes two leg rods and two connecting rods;

both ends of the leg fixing tube are fixedly connected to the two leg rods respectively; and both ends of the sliding block connecting tube is fixedly connected to the two connecting rods respectively.

3. The electrical mechanical stretching device of movable sofa of claim 1, wherein the driving part is a motor.

4. The electrical mechanical stretching device of movable sofa of claim 3, wherein the motor further includes a motor guide rail;

a motor head, fixedly connected to the motor guide rail; wherein the sliding block is mounted on the motor guide rail;

the driving device further includes a second rotating shaft; and the motor head is rotatably connected to the leg fixing tube via the second rotating shaft.

5. The electrical mechanical stretching device of movable sofa of claim 4, wherein the second rotating shaft is a pin.

6. The electrical mechanical stretching device of movable sofa of claim 4, wherein the driving device further includes a first rotating shaft, wherein the sliding block is rotatably connected to the sliding block connecting tube via the first rotating shaft.

7. The electrical mechanical stretching device of movable sofa of claim 6, wherein the first rotating shaft is a pin.

8. The electrical mechanical stretching device of movable sofa of claim 1, wherein the electrical mechanical stretching device of movable sofa further includes two bases and two bottom connecting tubes, wherein both ends of each bottom connecting tube is respectively connected to the two bases.

9. The electrical mechanical stretching device of movable sofa of claim 8, wherein the two bottom connecting tubes are parallel with the leg fixing tube and the sliding block connecting tube.

10. The electrical mechanical stretching device of movable sofa of claim 1, wherein the leg fixing tube is parallel with the sliding block connecting tube.

* * * * *